United States Patent [19]

Siemund et al.

[11] 4,416,705

[45] Nov. 22, 1983

[54] COMPOSITION AND PROCESS FOR PRODUCTION OF PHOSPHATE COATINGS ON METAL SURFACES

[75] Inventors: Gunter Siemund, Heusensramm; Han Y. Oei, Frankfurt, both of Fed. Rep. of Germany

[73] Assignee: Occidental Chemical Corporation, Warren, Mich.

[21] Appl. No.: 352,925

[22] Filed: Feb. 26, 1982

[30] Foreign Application Priority Data

Mar. 6, 1981 [DE] Fed. Rep. of Germany ..... 3108484

[51] Int. Cl.[3] ..... C23F 7/10; C04B 9/02

[52] U.S. Cl. ..... 148/6.15 Z; 106/14.12; 106/14.21

[58] Field of Search ..... 148/6.15 Z; 106/14.12, 106/14.21

[56] References Cited

U.S. PATENT DOCUMENTS

| | | | |
|---|---|---|---|
| 3,297,493 | 1/1967 | Blum et al. | 148/6.15 Z |
| 3,519,494 | 7/1970 | Engesser et al. | 148/6.15 Z |

FOREIGN PATENT DOCUMENTS

| | | | |
|---|---|---|---|
| 763628 | 2/1971 | Belgium | 148/6.15 Z |
| 1159728 | 12/1963 | Fed. Rep. of Germany | 148/6.15 Z |
| 2014115 | 4/1970 | France | 148/6.15 Z |

*Primary Examiner*—Michael R. Lusignan

*Attorney, Agent, or Firm*—Richard P. Mueller

[57] ABSTRACT

An aqueous acidic zinc phosphate solution which contains at least 6 g/l of Zn, at least 5 g/l $P_2O_5$, at least 1.0 g/l of an accelerator, calculated as $ClO_3$, from about 1 to about 50 g/l of sulfate ion, which solution has a total acid number of at least 20, a weight ratio of free $P_2O_5$ of 0.2–0.6:1 and a weight ratio of $P_2O_5$: Zn: $ClO_3$ of 1:0.5–4.0: 0.01–1.0. The phosphatizing bath preferably contains from about 1 to 5 g/l chlorate in combination with at least 8 g/l nitrate, with a weight ratio of $P_2O_5$: $NO_3$ of 1:0.2–6.0. The baths may be used to form phosphate coatings on ferrous metal surfaces using immersing or flow coating techniques and the phosphate coatings formed are found to have increased thickness and adhesion or coalescence to the metal surface.

7 Claims, No Drawings

COMPOSITION AND PROCESS FOR PRODUCTION OF PHOSPHATE COATINGS ON METAL SURFACES

This invention relates to a composition and process for the production of phosphate coatings on metal surfaces and more particularly relates to compositions and processes for forming heavy, coalescent phosphate coatings on iron and steel surfaces which are to be subjected to cold forming operations.

BACKGROUND OF THE INVENTION

It is known to apply phosphate coatings to metal surfaces by immersion or flow coating with aqueous acidic zinc phosphate solutions which contain chlorate or chlorate and nitrate as accelerators. In West German Offenlegungsschrift No. 21 06 626, chlorate-containing zinc phosphate solutions are disclosed in which the weight ratio of $P_2O_5$:Zn is maintained within the range of about 1:0.2–0.7. Similarly, from West German Patent Specification 10 96 152, it is known to use calcium irons in such solutions to improve the phosphate layer formation. In either case, however, undesirably long treatment times are required to obtain the formation of the desired continuous phosphate layer on the metal surfaces. Moreover, the phosphate layers obtained from the use of such processes have not always been satisfactory, particularly when used in subsequent cold forming operations, due to the undesirably low weight or thickness of the phosphate layer.

In an attempt to overcome these difficulties, phosphate coating solutions have been proposed in West German Offenlegungsschrift No. 25 40 685 which are acidic zinc phosphate solutions containing chlorate and nitrate accelerators and in which the weight ratio of $P_2O_5$:Zn is 1:0.8–4.0. With phosphating baths of this type, a phosphate layer is obtained having a crystalline structure which is somewhat softer than normal. This results in an increase in the absorptive capacity of the layer for a subsequently applied lubricant, such as is obtained by treatment with an aqueous soap solution, prior to a cold forming operation. Particularly good results have been obtained with a phosphatizing bath of this type which contained at least 6 g/l of zinc, at least 5 g/l $P_2O_5$, at least 1 g/l $ClO_3$, at least 8 g/l $NO_3$, with a total acid number of from 20 to 80 and in which the weight ratio of $P_2O_5$:Zn:$NO_3$:$ClO_3$ was equal to 1:1.5–4.0:2.0–6.0:0.03–2.0 and the weight ratio of free $P_2O_5$:total $P_2O_5$ was equal to 0.2–0.6:1. In operation, the excellent coating results with this bath were obtained by replenishing the bath with a phosphating solution in which the weight ratio of $P_2O_5$:Zn:$NO_3$:$ClO_3$ was 1:0.4–0.8:0.1–0.6:0.15–0.6 and the weight ratio of free $P_2O_5$:total $P_2O_5$ was 0.2–0.7:1.

In spite of the fact that the phosphate coatings obtained from the operations of such phosphatizing processes have very good properties and provide a considerable improvement over prior processes, they are sometimes subjected to cold forming operations which require even greater thickness and coalescence of the phosphate layer to the metal substrates than can be obtained from such processes.

It is, therefore, an object of the present invention to provide an improved phosphating composition and process which will form phosphate coatings that are capable of meeting the most stringent requirements presently known in regard to the thickness of the phosphate layer and its coalescence to the metal substrate.

This and other objects will become apparent to those skilled in the art from the description of the invention which follows.

SUMMARY OF THE INVENTION

In accordance with the present invention, an aqueous acidic zinc phosphate solution it is provided in which the weight ratio of $P_2O_5$:Zn:$ClO_3$ is equal to about 1:0.5–4.0:0.01–1.0 and which, additionally, contains from about 1 to about 50 g/l of sulfate ions. Suprisingly, it has been found that the addition of sulfate ions to an aqueous acidic zinc phosphate bath having the weight ratio of $P_2O_5$:Zn:$ClO_3$ set forth above, results in an appreciable thickening of the phosphate layer deposited, which increase is often as much as about 50 percent. Additionally, the resulting phosphate layer is found to have improved coalescence or adhesion to the metal surface on which it is applied.

DETAILED DESCRIPTION OF THE INVENTION

More particular, in the practice of the present invention, the aqueous zinc phosphate baths used will contain at least 7 g/l zinc, at least 5 g/l $P_2O_5$, at least 1.0 g/l of accelerator calculated as $ClO_3$ and will have a total acid number of at least 20 and a weight ratio of free $P_2O_5$:total $P_2O_5$ of 0.2–0.6:1. These components will be present in the weight ratios as set forth above.

Typically, the phosphatizing bath used may contain chlorate as the only accelerator. In this instance, the chlorate content of the bath calculated as $ClO_3$, should be at least 1.0 g/l. Preferably, the phosphating baths will contain up to about 5 g/l of chlorate with amounts of from about 0.2 to about 2.0 g/l being particularly preferred.

In a particularly preferred embodiment, the phosphating baths of the present invention will also contain nitrate ions, as accelerators, in addition to the chlorate. In this instance, the total amount of chlorate ions and nitrate ions in the baths must be at least 1.0 g/l, with the specific amounts of the nitrate ions being calculated as the oxidation equivalent of chlorate. In such preferred embodiment, the amount of $NO_3$ will be at least about 8 g/l and the weight ratio of $P_2O_5$:$NO_3$ 3 should be about 1:0.2–6.0.

As has been set forth hereinabove, the phosphating solutions of the present invention will contain from about 1 to about 50 g/l of sulfate ions. Preferably, the baths will contain the sulfate ions in amounts from about 5 to about 20 g/l. Such amounts of sulfate ions have been found to produce particularly advantageous thickening of the phosphate deposit and coalescence or adhesion of the deposit to the metal surface.

The phosphating baths of the present invention may also contain other, commonly used additives, such as copper, nickel, cobalt, as well as simple and complex fluorides. In regard to the addition of fluorides, it is important that the amount of fluoride added to the bath is maintained below that at which insoluble fluroide compounds are formed. Typically, the phosphatizing baths of the present invention may contain from about 5 to 1000 mg/liter of nickel ions and/or from about 1 to about 50 mg/liter of copper ions.

The phosphatizing baths of the present invention may be made up and replenished utilizing suitable concentrate compositions, Generally, it is preferred that the concentrate compositions used for both make up and replenishing contain all of the components required, in the necessary amounts and weight ratios, except for the sulfate ions. The sulfate is preferably added separately to the bath, whether for make up or replenishment, in the form of any bath-soluble sulfate compound. Particularly preferred sulfate compounds which may be used are zinc sulfate, e.g., $Zn\ SO_4.\ 7H_2O$, and sodium sulfate, e.g., $Na_2SO_4$.

In a particularly preferred embodiment of the present invention, the aqueous acidic zinc phosphate phosphatizing bath made up with the component amounts and ratios described above, is replenished with a composition in which the weight ratio of $P_2O_5$:Zn:$NO_3$:$ClO_3$ is 1:0.36–0.80:0.10–0.60:0.15–0.60 and which has a weight ratio of free $P_2O_5$:total $P_2O_5$ of 0.20–0.70:1. As has been noted hereinabove, when using such composition for replenishment of the baths, the sulfate content of the bath will also be maintained within the desired amounts by the separate addition of a suitable bath-soluble sulfate compound.

In the operation of the process of the present invention, it is preferred that the ferrous surfaces, e.g., iron and steel, to be treated are free from rust and scale. Typically, the surfaces to be treated will be degreased with an organic solvent or an alkaline detergent, followed in the latter instance by water rinsing, and will, thereafter, be pickled in an organic acid, such as HCl or $H_2SO_4$ to remove scale and rust, and will then be finally rinsed with cold water. If desired, prior to treatment with the phosphatizing solutions of the present invention, the metal surfaces may also be activated with a hot water rinse or with an activating titanium orthophosphate dispersion.

The surfaces to be coated are then contacted with the phosphatizing solutions of the present invention, preferably by immersion or flow-coating techniques. Typically, the temperature of the phosphatizing solutions are maintained within the range of about 35° to 98° C. The solutions are maintained in contact with the surface for a period of time sufficient to form the desired phosphate coating on the surface. Contact times from about 5 to 15 minutes are typical. During operation of the coating process, the acid number of the coating bath should be maintained at at least 20, and typically within the range of about 20 to 80. This desired acid number is maintained by replenishment of the bath with the replenishment composition as has been described hereinabove.

Following the treatment with the solution of the present invention, the phosphate coated parts are then typically rinsed with cold water and, if desired, subjected to a subsequent after treatment with a passivating rinse solution. Alternatively, where the coated parts are to be subjected to a cold forming operation, a suitable lubricant, such as a soap-lubricant, e.g., sodium stearate, and/or lubricant carrier salts, such as borax, lime, or the like, may be applied to the phosphate coated surface.

The composition and processes of the present invention have been found to be particularly effective in the preparation of phosphate and lubricant coated surfaces for cold forming operations. The phosphate coatings produced are, however, also suitable for providing corrosion protection to metal surfaces and for reducing sliding friction between metal surfaces, without the application of a subsequent lubricant coating.

SPECIFIC EXAMPLES

In order that those skilled in the art may better understand the present invention and the manner in which it may be practiced, the following specific examples are given. In these examples, steel sheets of grade U St 1305 m were degreased with perchloroethylene vapors, pickled in 20% $H_2SO_4$ at 60° C. for 5 minutes and then rinsed with cold water. The sheets were then immersed in the phosphating bath, which was at a temperature of 65° C., for 10 minutes. After removal from the phosphating baths, these sheets were rinsed with cold water and dried with compressed air.

EXAMPLE 1

An aqeuous acidic zinc phosphate solution was formulated which containe 17.9 g/l Zn, 14.9 g/l $P_2O_5$, 8.6 g/l $NO_3$, 0.02 g/l Ni, 0.5 g/l $ClO_3$, and 13.0 g/l $SO_4$. The sulfate ions were introduced into this bath by the addition of $Zn\ SO_4.7H_2O$. The resulting bath had a total acid number of 53 and a free acid number of 7.6. This solution was used to treat steel sheets in accordance with the process described hereinabove. Following this procedure, a phosphate layer was formed on the treated surface having a coating weight of 11.0 g/m$^2$.

EXAMPLE 2

The procedure of Example 1 was repeated with the exception that the aqueous acid zinc phosphate solution contained 11.0 g/l Zn, 18.1 g/l $P_2O_5$, 8.6 g/l $NO_3$, 0.02 g/l Ni, 0.5 g/l $ClO_3$, and 13.0 g/l $SO_4$. In this instance, the sulfate ions were added to the bath by the addition of $Na_2SO_4$. This bath had a total acid number of 52 and a free acid number of 9.4. The phosphate coating produced on the metal surface following the procedure described had a coating weight of 10.0 g/m$^2$.

EXAMPLE 3

An aqueous zinc phosphate solution was formulated as in Example 2 with the exception that the $NO_3$ content of the bath was 10.6 g/l and there was no $SO_4$ in the solution. The total acid number of this bath was 50 and the free acid number was 9.0. Using the procedure set forth hereinabove, the phosphate coating produced on the metal surface treated had a coating weight of 6.7 g/m$^2$.

EXAMPLE 4

Using the aqueous acid zinc phosphating solutions described in Examples 1, 2 and 3, phosphate coatings were formed on steel wire in accordance with the process described. Thereafter, a sodium stearate soap lubricant was applied to the phosphate coated surfaces and the wire was subjected to a multistage cold forming operation for the production of screws. Following the cold forming operation, it was found that the screws produced from the wire treated with the phosphating solutions of Examples 1 and 2 were completely coated with a continuous, faultless, firmly adherent phosphate layer. In contrast, screws produced from wire coated with the solution of Example 3 had numerous bright metallic spots indicating that at these points, the phosphate layer had been completely removed during the cold forming operation.

From the results which have been described hereinabove, it is apparent that the phosphate coatings produced from the aqueous acid zinc phosphate solutions of the present invention are appreciably heavier and more adherent than coatings produced from similar solutions which do not contain sulfate ions.

What is claimed is:

1. An aqueous acidic zinc phosphate solution which comprises at least 6 g/l of Zn, at least 5 g/l $P_2O_5$, at least 1.0 g/l of an accelerator, calculated as $ClO_3$, and about 1 to about 50 g/l of $SO_4$, which solution has a total acid number of at least 20, a weight ratio of free $P_2O_5$:total $P_2O_5$ of 0.2–0.6:1 and a weight ratio of $P_2O_5$:Zn:$ClO_3$ of 1:0.5–4.0:0.01–1.0.

2. The composition as claimed in claim in which $ClO_3$ is present in an amount from about 1 to about 5 g/l.

3. The composition as claimed in claim 2 in which the $ClO_3$ is present in an amount from about 0.2 to about 2 g/l.

4. The composition as claimed in claim 1 in which the sulfate ions are present in an amount of from about 5 to about 20 g/l.

5. The composition as claimed in claim 2 in which $NO_3$ is present in an amount of at least 8 g/l and the weight ratio of $P_2O_5$:$NO_3$ is 1:0.2–6.0.

6. A process for forming phosphate coating on ferrous metal surfaces which comprises contacting the surface to be coated with the aqueous zinc phosphate solution of claims 1, 2, 3, 4, or 5 and maintaining the surface in contact with such solutions for a period of time sufficient to form the desired phosphate coating.

7. A process for forming phosphate coatings on ferrous metal surfaces which comprises contacting the ferrous metal surface to be coated with the aqueous acidic zinc phosphate solution of claims 1, 2, 3, 4, or 5, maintaining the solution in contact with the surface for a period of time sufficient to form the desired phosphate coating and maintaining the desired total acid number of the phosphate coating solution by the addition of an aqueous acidic zinc phosphate replenishment composition having a weight ratio of $P_2O_5$:Zn:$NO_3$:$ClO_3$ of 1:0.36–0.80:0.10–0.60:0.15–0.60 and a weight ratio of free $P_2O_5$:total $P_2O_5$ of 0.20–0.70:1.

* * * * *